United States Patent [19]

Cupolo et al.

[11] 4,383,831

[45] May 17, 1983

[54] STABILIZED SUSPENSION SYSTEM

[75] Inventors: John Cupolo, Bristol; David J. Salisbury, Barrington; Charles W. Ouellette, Portsmouth, all of R.I.

[73] Assignee: Raytheon Company, Lexington, Mass.

[21] Appl. No.: 249,264

[22] Filed: Mar. 30, 1981

Related U.S. Application Data

[60] Continuation of Ser. No. 63,626, Aug. 3, 1979, abandoned, which is a division of Ser. No. 939,562, Sep. 5, 1978, Pat. No. 4,186,370.

[51] Int. Cl.[3] ..... B63B 21/52

[52] U.S. Cl. ..... 441/22

[58] Field of Search ..... 367/3, 4, 130; 114/244, 114/245, 126, 311; 244/138 A; 441/21, 22, 23, 24, 25, 26, 27

[56] References Cited

U.S. PATENT DOCUMENTS

| | | | |
|---|---|---|---|
| 2,519,123 | 8/1950 | Dwyer et al. | 244/138 A |
| 2,918,235 | 12/1959 | Aberg et al. | 244/138 A |
| 3,113,285 | 12/1963 | Edwards | 367/3 |
| 3,165,281 | 1/1965 | Gohlke | 244/138 A X |
| 3,444,508 | 5/1969 | Granfors et al. | 367/3 |
| 3,755,836 | 9/1973 | Milazzo | 9/8 R |
| 3,793,623 | 2/1974 | Gongwer | 114/244 |

*Primary Examiner*—Sherman D. Basinger

*Attorney, Agent, or Firm*—Martin M. Santa; Joseph D. Pannone

[57] ABSTRACT

A suspension system for an air-dropped sonobuoy includes a transducer housing wherein the upper portion is emptied upon deployment of a float. The weight distribution of the transducer and housing provide for a center of mass and a center of buoyancy at a location beneath a pivot in the upper portion of the housing. A suspension line connects the pivot with the float, and a pair of opposed extensible fins at the top of the housing locate the center of hydrodynamic pressure at the pivot. Thereby, the housing is maintained in a stabilized vertical attitude during descent through the water and during deployment at a predetermined depth independently of a difference in velocity of fluid movement at the float and at the sonobuoy.

8 Claims, 6 Drawing Figures

STABILIZED SUSPENSION SYSTEM

CROSS-REFERENCE TO RELATED CASES

This is a continuation of application Ser. No. 063,626, now abandoned, filed Aug. 3, 1979 which was a divisional of application Ser. No. 939,562, filed Sept. 5, 1978, now U.S. Pat. No. 4,186,370.

BACKGROUND OF THE INVENTION

Sonobuoys are commonly deployed in the ocean by suspending the sonobuoy from a float at the surface of the ocean so that the sonobuoy is located at a point beneath the surface of the ocean. In the case of sonobuoys deployed from aircraft, the upper portion of the buoy housing is frequently provided with a parachute for controlling the speed of drop through the air, the housing further including a float plus a float expansion device, such as a cylinder of a compressed gas, which is activated upon contact with the water whereupon the buoy is suspended from the float.

A problem arises in that sonobuoys may carry a transducer, or array of transducers for transmitting and/or receiving sonar signals in predetermined directions. To provide a reference axis for determining these directions, it is desirable to maintain a longitudinal axis of the sonobuoy in a vertical direction during descent to a predetermined depth and during deployment at the predetermined depth. However, it has been found that with buoy suspension systems of the prior art, the action of the wave motion as well as differential velocities between horizontal strata of the ocean water upon the float and upon the buoy in concert with the tension of the cable securing the buoy to the float introduces a rocking motion to the sonobuoy with a resultant continuous variation in the orientation of the longitudinal axis about a vertical direction.

SUMMARY OF THE INVENTION

The aforementioned problem is overcome and other advantages are provided by a suspension system for a sonobuoy which permits the suspension of the sonobuoy at a predetermined depth by a cable tethered to a float in a manner which neutralizes the effect of the water motion so as to maintain the longitudinal axis of the sonobuoy in a vertical direction, the invention also providing a stabilized vertical attitude to the sonobuoy during descent through the water to the predetermined depth. In accordance with the invention, the components of the sonobuoy including the housing thereof, are arranged such that, upon evacuation of the parachute and floatation from an upper chamber of the housing, the resulting center of mass and center of buoyancy are located below the bottom of the chamber. A suspension cable for tethering the sonobuoy to the float is attached at the bottom of the chamber directly above the centers of mass and of buoyancy, the cable passing along the central portion of the chamber without contacting the side thereof. Fins symmetrically positioned about a longitudinal axis of the sonobuoy are deployed in planes tangential to a cylindrical surface of the housing. The sonobuoy may be deployed by lowering it from the side of a ship or by dropping it from an aircraft into the ocean.

In a preferred embodiment of the invention, the fins are formed of flexible metal sheets which are secured around the exterior portion of the housing prior to deployment of the sonobuoy, the fins extending outwardly by spring action of the metal sheets upon deployment of the sonobuoy. A pair of diametrically opposed fins has been successfully deployed, each fin having a short rear leg and a longer front leg, the configuration of the fins mounted to the cylindrical surface of the housing providing for the development of hydrodynamic forces in two orthogonal directions having symmetry about the longitudinal axis of the sonobuoy. In the presence of a differential speed of water movement between water at the surface of the ocean and water at the depth of the sonobuoy, the cable is included at an angle to the vertical resembling the situation wherein a sonobuoy is being slowly towed through the water. The presence of a short leg and a long leg for each of the fins causes the plane of a fin to be angled relative to the direction of the towing. With sonobuoys of the prior art, the towing of the sonobuoy by the cable has resulted in a nodding movement of the sonobuoy in a plane transverse to the direction of towing. However, with the stabilized suspension system of the invention, the aforementioned nodding movement has been essentially eliminated. In addition, it has been found that the configuration of the fins has produced greater stability during descent of the sonobuoy to the predetermined depth than has heretofore been observed.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
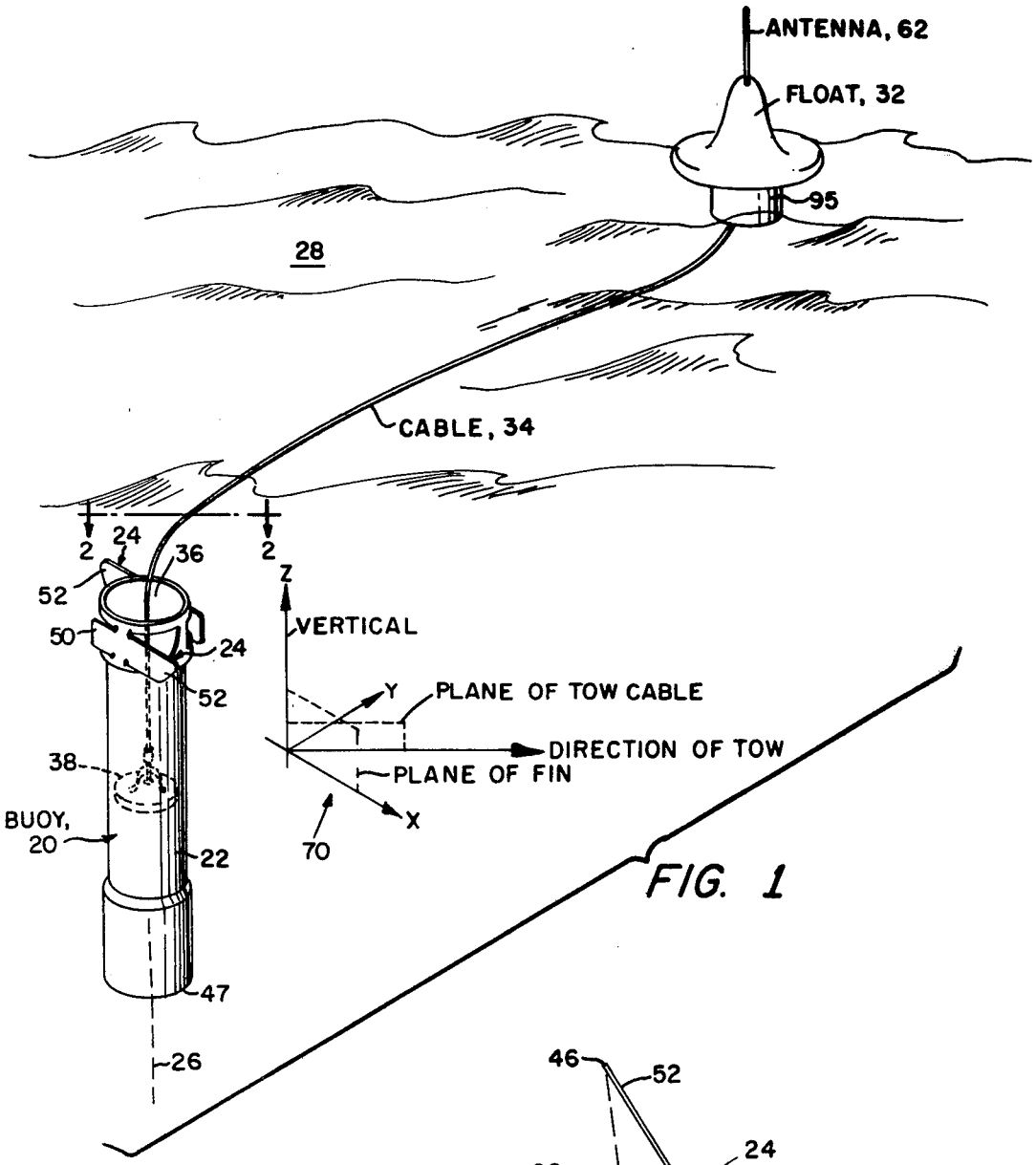
FIG. 1 is a view, partially diagrammatic, of a sonobuoy being supported by a stabilized suspension system of the invention, the figure showing the tethering of the support cable and the extended fins.

Referring now to FIGS. 1–4, a sonobuoy 20 comprises, in accordance with the invention, a cylindrical housing 22 with a pair of diametrically opposed fins 24 mounted tangentially to the cylindrical housing 22. The fins 24 lie substantially in planes which are parallel to a longitudinal axis 26 of the sonobuoy 20.

The sonobuoy 20 is shown deployed in the ocean 28 and, accordingly, an upper chamber 30 of the housing 22 is shown evacuated, a parachute (seen in FIG. 6) and a float 32 having been ejected from the chamber 30 upon the dropping of the sonobuoy 20 into the ocean 28 from an aircraft (not shown). A cable 34 secures the sonobuoy 20 to the float 32, the lower end of the cable 34 being pivotably attached to the interior of the housing 22 at the bottom of the chamber 30 while the upper end of the cable 34 is attached to the float 32. The tap portion of the chamber 30 is open, the opening 36 at the top of the chamber 30 being sufficiently large to permit suspension of the sonobuoy 20 from a pivot 38 by the cable 34 without a contacting of the cable 34 by the rim of the opening 36. The pivot 38, the center of buoyancy, and the center of mass all lie along the axis 26.

Figure 3:
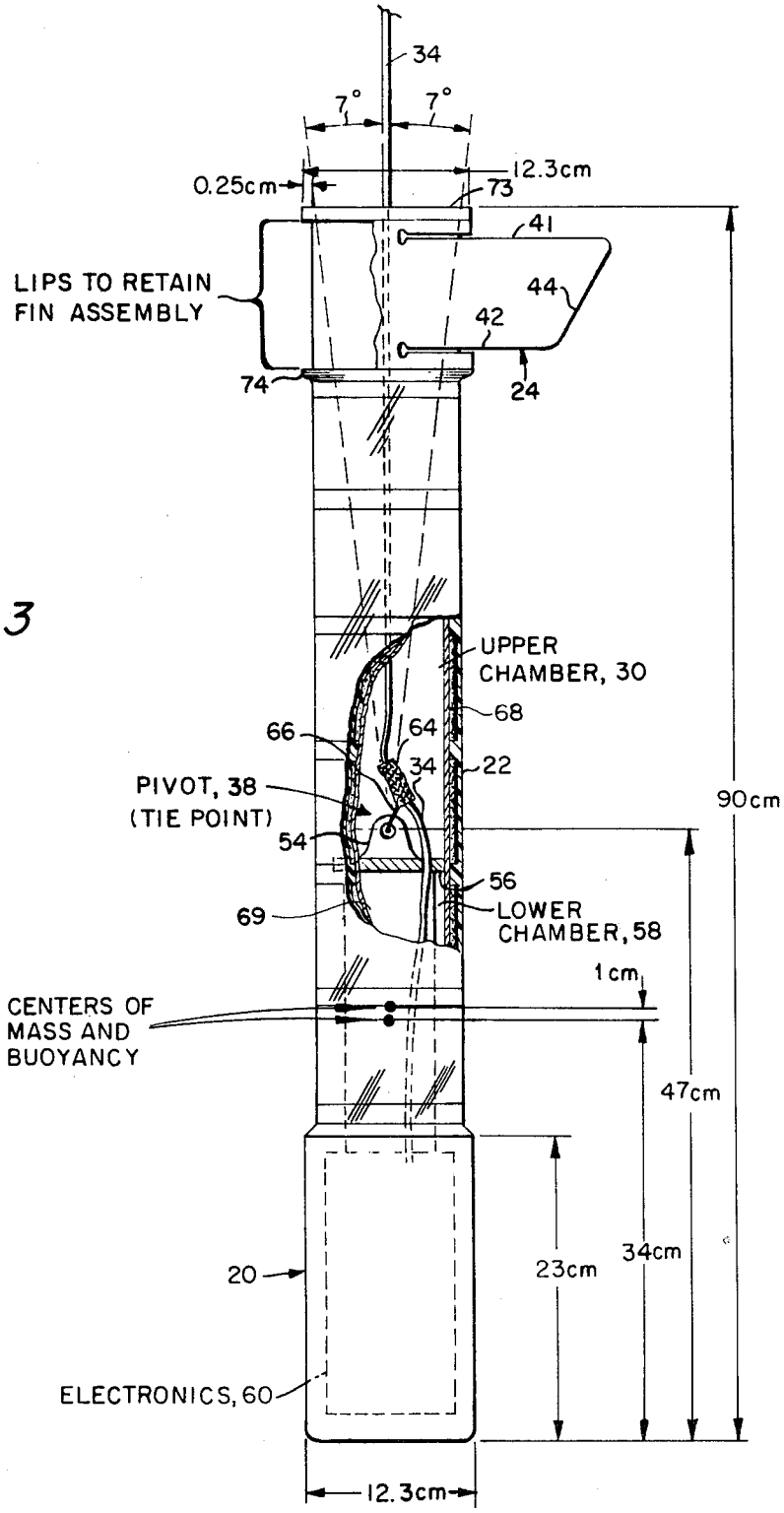
FIG. 3 is an elevation view of the sonobuoy of FIG. 1, partially cut away to show the cable tie point, the fins being partially shown to expose a mounting surface bounded by lips for retaining the fins.

As seen in FIG. 3, the center of mass and the center of buoyancy lie below the pivot 38. In the preferred embodiment of the invention, the distance between the center of buoyancy and the center of mass is less than approximately 5% of the total length of the sonobuoy 20. The distance between the pivot 38 and the center of buoyancy lies within the range of 10% to 20% of the total length of the housing 22. The ratio of the length of the housing 22 to the diameter of the opening is in the range of ratios 3:1 to 10:1. The length of the chamber 30 is in the range of 40% to 60% of the total length of the housing 22. The weight of the sonobuoy 20, as deployed in FIG. 1, is 39 pounds. These dimensions may be increased or decreased from the aforementioned ranges to accommodate specific forms of water turbulence, such as that of a first moving current. The aforementioned ranges have been found useful for deployment of the sonobuoy 20 in the ocean for submergence at depths ranging from shallow water to hundreds of feet.

Figure 4:
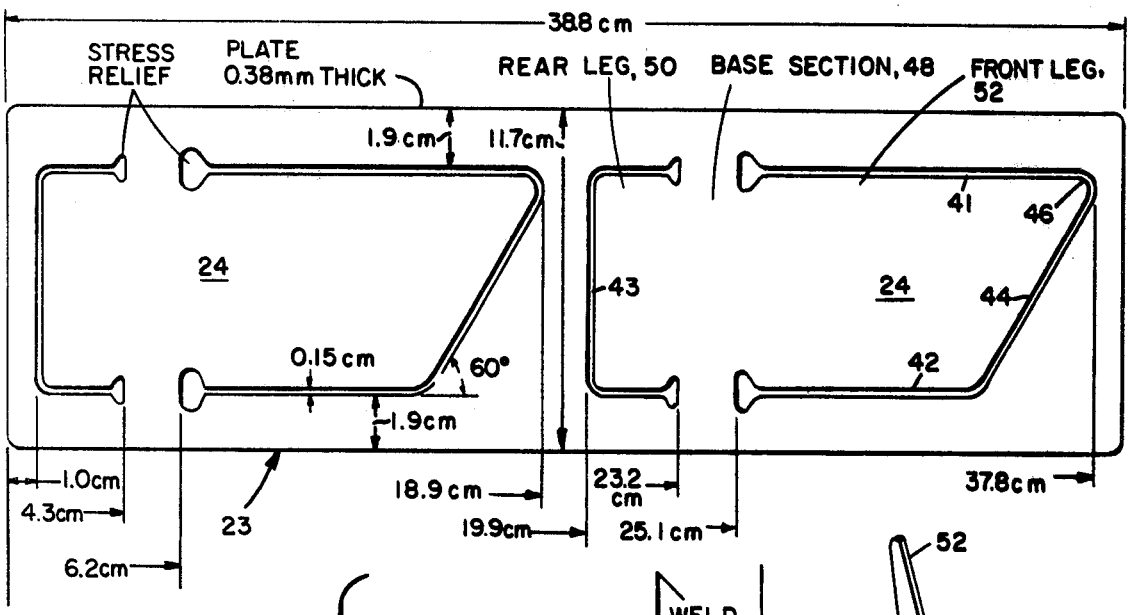
FIG. 4 shows a plane view of a fin assembly of FIG. 1 prior to its being coiled around the sonobuoy housing.

The plan view of FIG. 4 shows a fin assembly 23 and the dimensions of an individual fin 24 for use with a sonobuoy having the dimensions shown in FIG. 3. The fin 24 has two parallel sides 41 and 42 which extend laterally from the housing 22 of FIG. 1, a perpendicular side 43 and an inclined side 44. In the preferred embodiment of the invention, an apex 46 and the side 41 are located adjacent the opening 36 while the side 42 is directed toward the nose 47 of the sonobuoy 20. A base section 48 of the fin 24 separates the fin 24 into a short rear leg 50 and a longer front leg 52, the base section 48 also securing the fin 24 to the fin assembly 23.

The pivot 38, by which the cable 34 is secured to the housing 22, comprises a boss 54 on a bulkhead 56 which separates the upper chamber 30 from a lower chamber 58. The cable 34 comprises a set of electrical conductors for communicating electric signals from electronic equipment 60 in the sonobuoy 20 to be coupled via an antenna 62 for communication with the aircraft. The cable 34 has sufficient strength for supporting the sonobuoy 20. The cable 34 is attached to the boss 54 by means of a woven jacket 64 which tightly adheres to the cable 34 and has an appendage 66 which is tied to the boss 54. The cable 34, after passing through the jacket 64, passes through an aperture in the bulkhead 56 for connection with the equipment 60. The equipment 60 is powered by a battery 69 and includes circuitry for the transmission and reception of sound waves via a set of transducer elements 68 (partially shown in FIG. 3) circumferentially mounted around the central portion of the housing 22.

Coordinate axes 70 adjacent the sonobuoy 20 in FIG. 1 shows the relative orientations of a plane containing the cable 34 and a plane containing one of the fins 24. FIG. 1 portrays the situation wherein the water of the ocean 28 is in motion, the motion being characterized by the heaving of the float 32 by waves on the surface of the ocean 28, the motion being further characterized by the heaving of the float 32 by waves on the surface of the ocean 28, the motion being further characterized by horizontal movement of the water in various strata such that the horizontal movement of water at the depth of the sonobuoy 20 is of a different velocity than the horizontal movement of the water at the surface of the ocean 28. Thus, there is a differential velocity in the horizontal planes between the water velocity at the sonobuoy 20 and the water velocity at the float 32. As portrayed in FIG. 1, the float 32 is seen to be moving toward the right of the sonobuoy 20 and, accordingly, appears to be towing the sonobuoy 20. The direction of the towing is shown in the coordinate axes 70. The direction of tow lines in the plane of the cable 34 and, accordingly, is angled with reference to the plane of a fin 24 as seen also in FIG. 2. The direction of tow is perpendicular to the longitudinal axis 26 of the sonobuoy 20, the axis 26 being parallel to the Z axis of the coordinate axes 70.

The towing of the sonobuoy 20 produces hydrodynamic forces acting along the surface of the sonobuoy 20 in a direction opposite to the direction of tow. The towing speed is generally less than one-half knot. The resultant hydrodynamic pressures are distributed along the surfaces of the sonobuoy 20 and the fins 24. Also a drag is introduced at the opening 36 of the upper chamber 30. The bulkhead 56 and the boss 54 have been located so that the pivot 38 lies in the transverse plane of the sonobuoy 20 containing the center of the hydrodynamic pressure acting on the sonobuoy 20.

Figure 2:
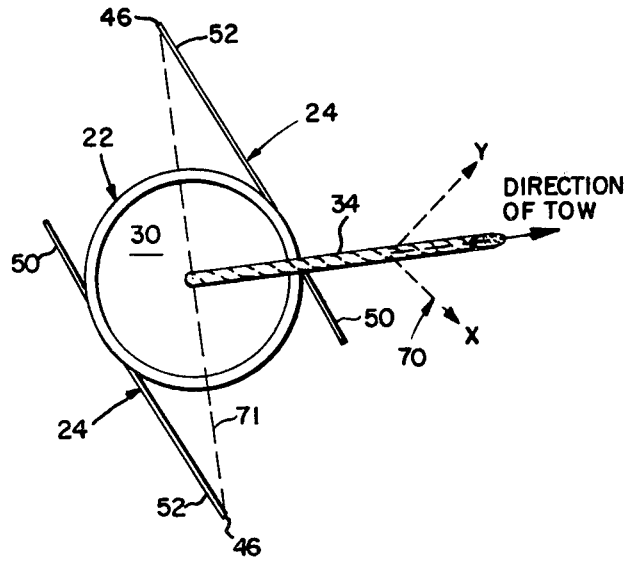
FIG. 2 shows a plan view of the top of the sonobuoy and cable of FIG. 1 taken along the line 2—2 of FIG. 1.

As seen in FIG. 2, a dashed line 71 joining the apices 46 is approximately perpendicular to the direction of the towing by the cable 34. However, the plane of a fin 24, as noted above, is inclined relative to the direction of two because of the difference in length between the rear leg 50 and front leg 52. Testing with numerous fin configurations has shown that the asymmetrical form of a fin, namely, the unequal lengths of the rear leg 50 and front leg 52, in combination with the symmetrical mounting of the fins 24 about the sonobuoy axis 26 having produced the most stability of all of the tested fin configurations. It is believed that the inclination of the plane of a fin 24 relative to the direction of tow is a major contributing factor to the stability of the sonobuoy 20.

The center of mass may be positioned adjacent the center of buoyancy by placing a weight (not shown) in the nose 47 of the sonobuoy 20. In the preferred embodiment, the center of mass and the center of buoyancy are positioned within approximately one centimeter of each other. The primary moment for urging the sonobuoy 20 to a vertical attitude is provided by the spacing of the pivot 38 and the center of buoyancy, this distance being approximately 13 centimeters in the preferred embodiment of the invention.

The dynamic response of the sonobuoy 20 to tensile forces in the cable 34 depends on the hydrodynamic forces and also on the virtual mass of the sonobuoy 20, the virtual mass including the mass of the water which floods the upper chamber 30 and the mass of the water entrapped by the fins 24. The size of the fins 24 affects the amount of the water entrapped by the fin 24 as well as the location of the center of hydrodynamic pressure resulting from the towing. Increasing the width of the fins 24, as measured in the direction of the axis 26 of FIG. 1, from the value shown in FIG. 2 raises the center of hydrodynamic pressure for an increased moment about the center of buoyancy to resist a nodding movement of the sonobuoy 20 in a plane of the axis 26. The dimensions of the sonobuoy 20 utilized in the building of the preferred embodiment of the invention are shown in FIG. 3. The fins 24 are formed from the blank of the fin assembly 23 and have dimensions which are shown in FIG. 4. The relative difference in size between the rear leg 50 and the front leg 52 of a fin 24 as well as their respective positions relative to the housing 22 produce hydrodynamic forces which rotate the sonobuoy 20 about its axis 26 to the aforementioned orientation shown by the coordinate axes 70 wherein the plane of a fin 24 is angled to the direction of tow. The water entrapped in the upper chamber 30 and by the fins 24 serves to dampen any motion of the sonobuoy 20 to aid in preserving a stable attitude of the sonobuoy 20.

The fins 24 may be stamped or etched from a plate of tempered stainless steel, type AISI 301 full hardened spring steel, having a thickness of 0.38 mm (millimeters). The stamping includes the removal of material from the plate to provide points of stress relief to permit the legs of the fins 24 to extend outwardly from the plate when the fin assembly 23 is secured about the top portion of the sonobuoy 20.

Figure 5:
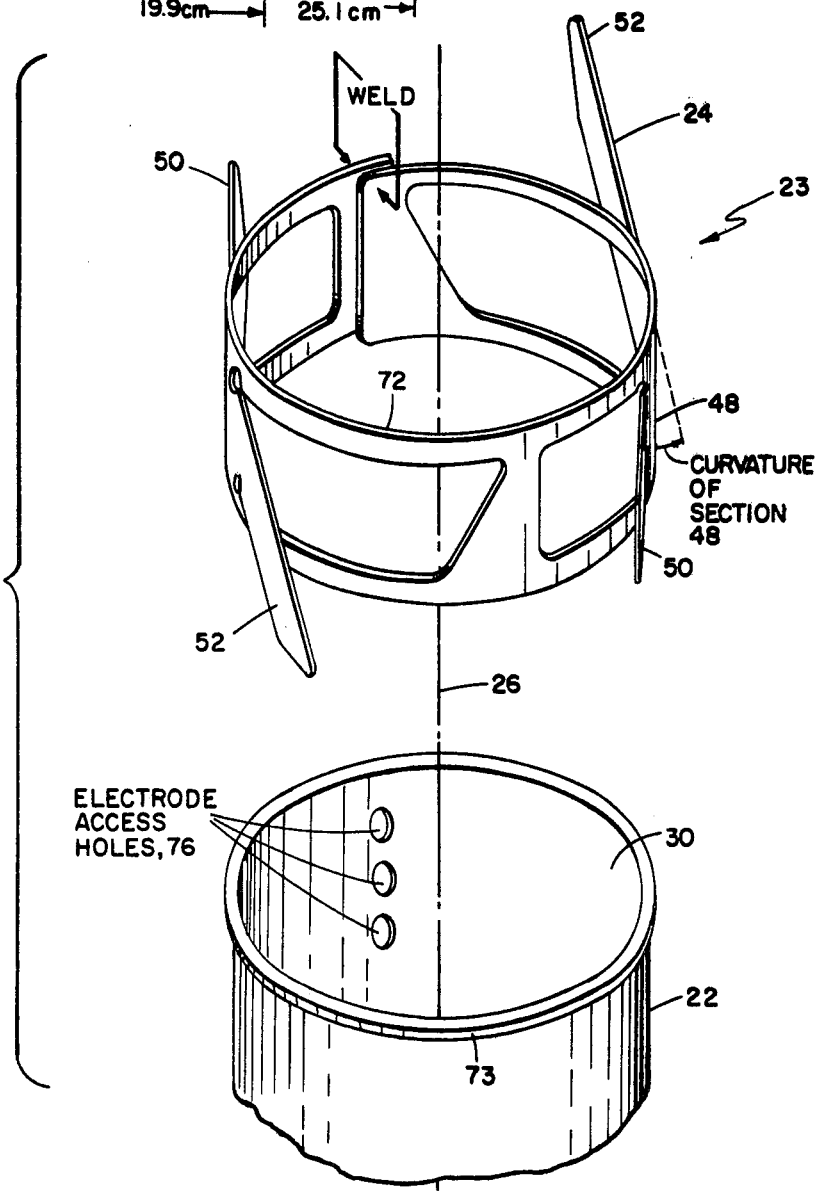
FIG. 5 is an exploded view of the fin assembly of the sonobuoy showing the coiling about the housing and a welding of the fin assembly.

Referring also to FIG. 5, the manner of securing the fin assembly 23 to the top portion of the sonobuoy 20 is now described. The remaining portion of the plate from which the fins 24 have been formed serves as a band 72 for encircling the upper end of the housing 22, the band 72 having apertures therein at the locations of the legs 50 and 52 of the fins 24. The housing 22 has an upper lip 73 and a lower lip 74 for securing the band 72 in its position after attachment to the upper end of the housing 22. The band 72 is bent circularly around the axis 26 of the sonobuoy 20, and passed tightly around the housing 22 between the lips 73–74 whereupon the ends of the band 72 are spot welded together. To facilitate the welding operation, the ends of the band 72 are positioned in registration with a set of access holes 76 which permit an electrode utilized in the welding operation to pass through the wall of the housing 22 in the upper chamber 30 to contact an end of the band 72. The material utilized in fabricating the housing 22 differs from that utilized in fabricating the fins 24, the housing 22 being fabricated of a light weight material such as aluminum. The access holes 76 permit the welding operation to be performed independently of the characteristics of the material from which the housing 22 is formed.

The aforementioned thickness of the tempered, spring steel plate of the fin assembly 23 provides rigidity to the fins 24 during rapid movement of the sonobuoy 20 through the water as occurs in the situation wherein the sonobuoy 20 is deployed from an aircraft. A thinner plate may be utilized in the event that the sonobuoy 20 is to be deployed by being lowered from the side of a ship. In addition, a 60° angle of attack on the end of the front leg 52 of each fin 24 further facilitates rapid movement of the fins 24 through the water without the generation of hydrodynamic forces which might otherwise unduly bend and twist the fin beyond the yield point of the spring steel leaving a permanent deformation in the shape of the fins 24. Similarly, the stress relief, as shown in FIG. 4, further insures against any undesired deformation of the fin assembly 23.

Figure 6:
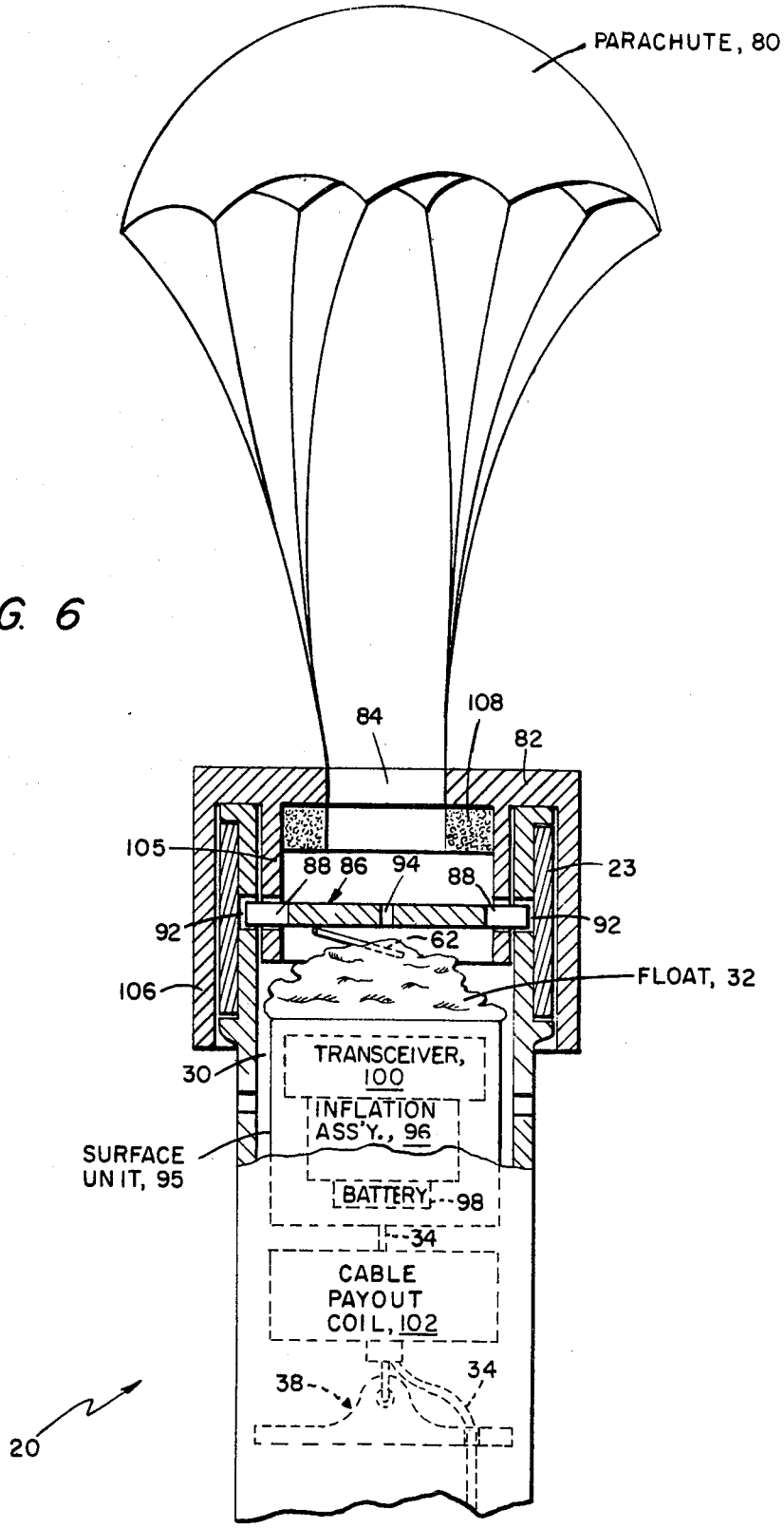
FIG. 6 shows a side view, partially cut-away to show portions in sectional view of a sonobuoy with the upper chamber thereof containing floatation prior to deployment of the float.

Referring now to FIG. 6, the upper portion of the sonobuoy 20 is shown prior to its entry into the ocean during deployment from an aircraft. A parachute 80 extends upwardly from the top of the sonobuoy 20 for regulating the speed of descent, the parachute 80 being initially stowed within a cover 82 of the sonobuoy 20. The parachute 80 is secured to the cover 82 and is deployed via an aperture 84 in the cover 82. The cover 82 is secured to the housing 20 by a plate 86 having tabs 88 which pass through apertures 91 of the cover 82 and apertures 92 of the housing 22. The plate 86, as seen in the sectional view thereof, contains a transverse slot 94 which extends across a major portion of the plate 86 to facilitate the bending of the plate 86 upon expansion of the float 32. The bending of the plate 86 causes a withdrawal of the tabs 88 from the aperture 91–92 thereby freeing the plate 86, the cover 82, and the float 32.

The upper chamber 30 of the sonobuoy 20 also includes a surface unit 95, seen also in FIG. 1, which is attached to the float 32 and comprises an inflation assembly 96, a battery 98, and a transceiver 100. The chamber 30 also includes a coil 102 of the cable 34 from which the cable 34 is unwound to pay out the cable 34 upon descent of the sonobuoy 20 below the surface of the ocean 28 of FIG. 1. The inflation assembly 96 comprises, by way of example, a cartridge of compressed gas which is released by an electrically operated plunger which punctures the cartridge for discharging the gas into the interior of the surface unit 95 from which it enters the float 32 to inflate the float 32. The battery 98 is activated upon contact with sea water entering the chamber 30 via ports 104 to energize the aforementioned plunger for releasing the gas. During deployment of the sonobuoy 20 beneath the surface of the ocean 28, the transceiver 100 at the surface of the ocean 28 communicates electrical signals to and from the sonobuoy 20 via the antenna 62 of FIGS. 1 and 6.

In operation, upon entry of the sonobuoy 20 into the water of the ocean 28, the salt water of the ocean 28 enters the ports 104 for activating the battery 98 to provide electric current to the inflation assembly 96 to produce the inflation of the float 32. Upon expansion of the float 32 under pressure of the inflating gas, the plate 86 bends to withdraw the tabs 88 and thereby free the plate 86. The float 32 then pushes the plate 86 and the cover 82 upward and away from the housing 22 of the sonobuoy 20 to permit the exit of the float 32 from the upper chamber 30. The transceiver 100, the battery 98 and the inflation assembly 96 are physically connected to each other and to the float 32 so that they remain at the surface of the ocean 28 upon deployment of the float 32. As the sonobuoy 20 descends into the ocean 28, the cable 34, secured between the transceiver 100 and the pivot 38, pays out from the coil 102 in a sufficient amount to suspend the sonobuoy 20 at a desired depth beneath the float 32.

Also shown in FIG. 6 is the fin assembly 23 secured about the upper end of the housing 22. During assembly of the sonobuoy 20, the extended fins 24 of FIG. 5, are bent inwardly and held in contact with the housing 22 to permit emplacement of the cover 82 about the fin assembly 23. The cover 82 comprises inner and outer cylindrical elements 105–106 between which is nested the upper end of the housing 22 with the fin assembly 23. The inner cylindrical element 105 contacts the tabs 88 for securing the cover 82 to the sonobuoy 20. The outer cylindrical element 106 confines the fins 24 within the cylindrical geometry of the sonobuoy 20 to permit the launching of the sonobuoy 20 from a cylindrical launching container in the aircraft. Upon expulsion of the cover 82 by the expansion of the float 32, the fins 24 of the fin assembly 23 spring outwardly to the position shown in FIG. 5. Thereupon, the rear leg 50 and the front leg 52 of each fin 24 assume a planar geometry. The base section 48 of each fin 24, seen in FIG. 4, retains the cylindrical shape of the band 72 so that the front and rear legs 50 and 52 of a fin 24 are angled slightly by typically a few degrees, as seen in FIG. 5. With the exception of the foregoing slight angularity in the relative orientation of the rear leg 50 and the front leg 52, these legs 50 and 52 may be regarded as being substantially coplanar as has been described in FIG. 1. If desired, the cover 82 may include floatation 108, in the form of a foamed polyurethane grommet, so that the parachute 80 and the cover 82 can float away from the sonobuoy 20 after its deployment.

It is understood that the above-described embodiment of the invention is illustrative only and that modifications thereof may occur to those skilled in the art. Accordingly, it is desired that this invention is not to be limited to the embodiment disclosed herein but is to be limited only as defined by the appended claims.

What is claimed is:

1. A stabilized suspension system for suspending an object within a fluid medium and for maintaining said object in a substantially vertical orientation within such medium, said suspension system comprising:

cable means extending through an open chamber of said object and affixed to said object at a point of said chamber opposite an opening of said chamber, said point being at substantially the longitudinal center of said object;

a set of symmetrically positioned fin means adjacent said opening and rigidly attached to said object;

the center of mass and the center of buoyancy of said object being located away from said opening and below the point of affixation of said cable means;

said fin means including a center of hydrodynamic pressure of said fluid medium on said object substantially at said point of said chamber to which said cable is affixed to maintain said object in the substantially vertical orientation within said medium irrespective of relative motion of said fluid transverse to the longitudinal axis of said object.

2. A system according to claim 1 wherein said fin means comprise fins mounted in planes parallel to a center line of said chamber.

3. A system according to claim 2 wherein each of said fins comprises a front leg and a back leg, said front leg being larger than said back leg.

4. A system according to claim 3 wherein said fins are symmetrically positioned about an axis of said object.

5. The apparatus of claim 1 wherein:

said chamber extends longitudinally within said object and has a chamber bottom to which said cable is affixed, said affixation being a pivotable affixation.

6. A system for stabilizing an object in a fluid medium comprising:

a cable means pivotably affixed to said object at the center of hydrodynamic pressure of the medium on said object;

a set of fin means comprising a pair of fins being mounted to said object diametrically opposite each other and symmetrically about the longitudinal axis of said object;

said fins being mounted along the axis of said object to provide a center of hydrodynamic pressure of said fluid medium at the point where said cable means is affixed;

each of said fins have a generally planar rectangular form and comprise a short leg and a long leg, said fins being mounted in planes parallel to said axis.

7. A system according to claim 6 wherein an end of said long leg is tapered to stabilize movement through said medium in a direction along said axis.

8. A system according to claim 6 wherein said fins are flexible, said system including means for stowing said fins curled around said object, and means for uncurling said fins upon deployment of said object.

* * * * *